US010625132B2

(12) United States Patent
McGetrick

(10) Patent No.: US 10,625,132 B2
(45) Date of Patent: Apr. 21, 2020

(54) PORTABLE TARGET GAME SYSTEM WITH TRIPOD ASSEMBLY

(71) Applicant: Kyle P. McGetrick, Santa Barbara, CA (US)

(72) Inventor: Kyle P. McGetrick, Santa Barbara, CA (US)

( * ) Notice: Subject to any disclaimer, the term of this patent is extended or adjusted under 35 U.S.C. 154(b) by 0 days.

(21) Appl. No.: 16/284,628

(22) Filed: Feb. 25, 2019

(65) Prior Publication Data

US 2019/0262682 A1 Aug. 29, 2019

Related U.S. Application Data

(60) Provisional application No. 62/634,517, filed on Feb. 23, 2018.

(51) Int. Cl.
*A63B 67/10* (2006.01)
*A63B 67/06* (2006.01)

(52) U.S. Cl.
CPC ..... *A63B 67/10* (2013.01); *A63B 67/06* (2013.01); *A63B 2067/063* (2013.01); *A63B 2210/50* (2013.01); *A63B 2225/093* (2013.01)

(58) Field of Classification Search
CPC ..... A63B 67/10; F41J 1/10
USPC ..... 273/332, 398–402; 473/476–479
See application file for complete search history.

(56) References Cited

U.S. PATENT DOCUMENTS 1,052,907 A 2/1913 Fergusson
2,095,390 A 10/1937 Lange et al.
2,942,886 A 6/1960 Ackerman
2,950,917 A 8/1960 Lyon
2,950,918 A 8/1960 Lyon
2,991,034 A 7/1961 Lyon
3,009,702 A 11/1961 Lyon
3,023,001 A 2/1962 Gourdouze
3,051,491 A 8/1962 Cabot
3,288,466 A 11/1966 Cumings
3,656,747 A 4/1972 Revell, Jr.
4,120,498 A 10/1978 Mutschler et al.
4,564,200 A 1/1986 Loring et al.
4,635,942 A 1/1987 Flaherty, Jr.
5,171,019 A 12/1992 Arnette
5,337,996 A * 8/1994 Kalish ..... A47B 97/04 248/448
8,011,664 B2 * 9/2011 Hilbert, Jr. ..... A63B 67/06 273/331

(Continued)

*Primary Examiner* — Jeffrey S Vanderveen

(74) *Attorney, Agent, or Firm* — Law Office of Mark Brown, LLC; Christopher M. DeBacker

(57) ABSTRACT

A portable system for setting up swinging target games featuring an anchored tossable object, such as a hook or a ring, and a target for receiving the tossable object. The entire assembly is designed to break down and collapse into a compact arrangement for easy transport. It should be storable in a bag or box. The system includes a central bracket which connects three telescoping or collapsible tripod legs for standing the bracket at a location. The bracket includes a connection for a telescoping arm to radiate up and away from the bracket and legs to a terminal point a distance away from the bracket. A target can be mounted to the bracket and a string can be anchored to the terminal point of the telescoping arm. The tossable object is hung from the string and can be tossed towards the target.

12 Claims, 14 Drawing Sheets

(56) References Cited

U.S. PATENT DOCUMENTS

| | | | | |
|---|---|---|---|---|
| 8,720,895 | B2 * | 5/2014 | Matthis | F41J 3/0004 248/188.7 |
| 8,720,896 | B2 * | 5/2014 | Matthis | F41J 1/10 248/163.2 |
| 9,267,769 | B1 * | 2/2016 | Gempler | B25H 1/06 |
| 2009/0206550 | A1 | 8/2009 | Pershin et al. | |
| 2015/0115530 | A1 | 4/2015 | Vanston | |
| 2016/0339315 | A1 * | 11/2016 | McGetrick | A63B 67/06 |
| 2016/0339333 | A1 * | 11/2016 | McGetrick | A63B 67/06 |

* cited by examiner

PORTABLE TARGET GAME SYSTEM WITH TRIPOD ASSEMBLY

CROSS-REFERENCE TO RELATED APPLICATION

This application claims priority in U.S. Provisional Patent Application No. 62/634,517 Filed Feb. 23, 2018, which is incorporated herein by reference.

BACKGROUND OF THE INVENTION

1. Field of the Invention

The present invention relates generally to a game system and method for use thereof, and more specifically to a portable game system including a tossable object anchored on a string, a target, and a collapsible tripod assembly.

2. Description of the Related Art

Popular gaming systems including ring toss games involving a ring, a hook, and a board have existed for a long time. Similar games which also involve a rod extending out above the board with a string affixed to the rod and the ring have also been around for quite some time. Variants of this game come in a number of names, such as "Bimini Ring," "Bimini Toss," "Tiki Toss," "Wallhooky," and, simply, "Ring Toss."

The typical set-up for such a game requires the user to place a hook somewhere, usually permanently. A ring is then affixed to a string by tying the string directly to the edge of the ring. The other end of the string is affixed to a ceiling of overhang, allowing the user to swing the ring from a starting position and attempt to hook the ring onto the hook. A ball may also be used to be tossed towards a basket-like goal.

The problem with existing game systems such as these is that they require appropriate structures and surfaces to anchor the string for the tossable object (e.g. ring or ball) and another structure and surface to place the target. Portable embodiments similar to this invention generally require a weighted base, anchor, or stake of some sort to provide a stable game that functions properly. Absent these features, existing games would be in danger of toppling or shifting during play.

Heretofore there has not been available a system or method for a game system with the advantages and features of the present invention.

BRIEF SUMMARY OF THE INVENTION

The present invention generally provides a portable system for setting up swinging target games featuring an anchored tossable object, such as a hook or a ring, and a target for receiving the tossable object. The entire assembly is designed to break down and collapse into a compact arrangement for easy transport. It should be storable in a bag or box.

The system includes a central bracket which connects three telescoping or collapsible tripod legs for standing the bracket at a location. The bracket includes a connection for a telescoping arm to radiate up and away from the bracket and legs to a terminal point a distance away from the bracket. A target can be mounted to the bracket and a string can be anchored to the terminal point of the telescoping arm. The tossable object is hung from the string and can be tossed towards the target.

All of the tripod legs, telescoping arm, and target can be separated from the bracket as desired. The legs and arm can be collapsed for easy storage and transport. Alternatively, these legs and arm could collapse and pivot about a central bracket element.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Game System 2

Figure 1:
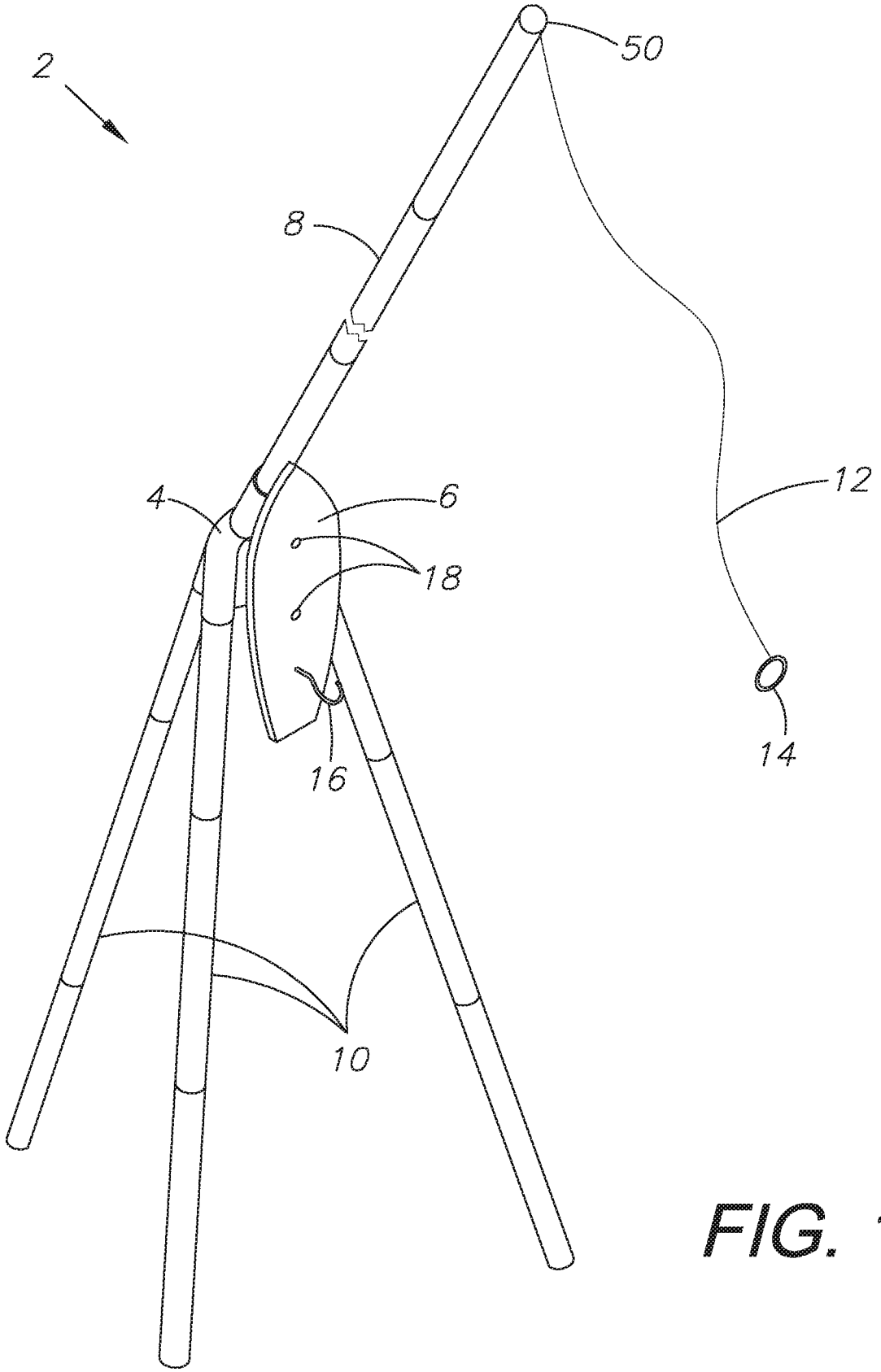
FIG. 1 is a three-dimensional isometric view of a preferred embodiment of the present invention.

The present invention is a ring toss game system 2 as shown in FIG. 1 which primarily consists of a bracket or yoke connector 4 which has a receiver 26 for a telescoping arm 8, three receivers 28 for respective tripod legs 10, and connectors 24 for receiving a target board 6. The bracket or yoke 4 receives and locks the telescoping arm 8 at an angle such that a terminal end point 50 of the arm extends outwardly and upwardly away from the target board 6. The tripod legs 10 raise the target board 6 and bracket 4 to a desired height off of a ground surface 11.

Figure 2:
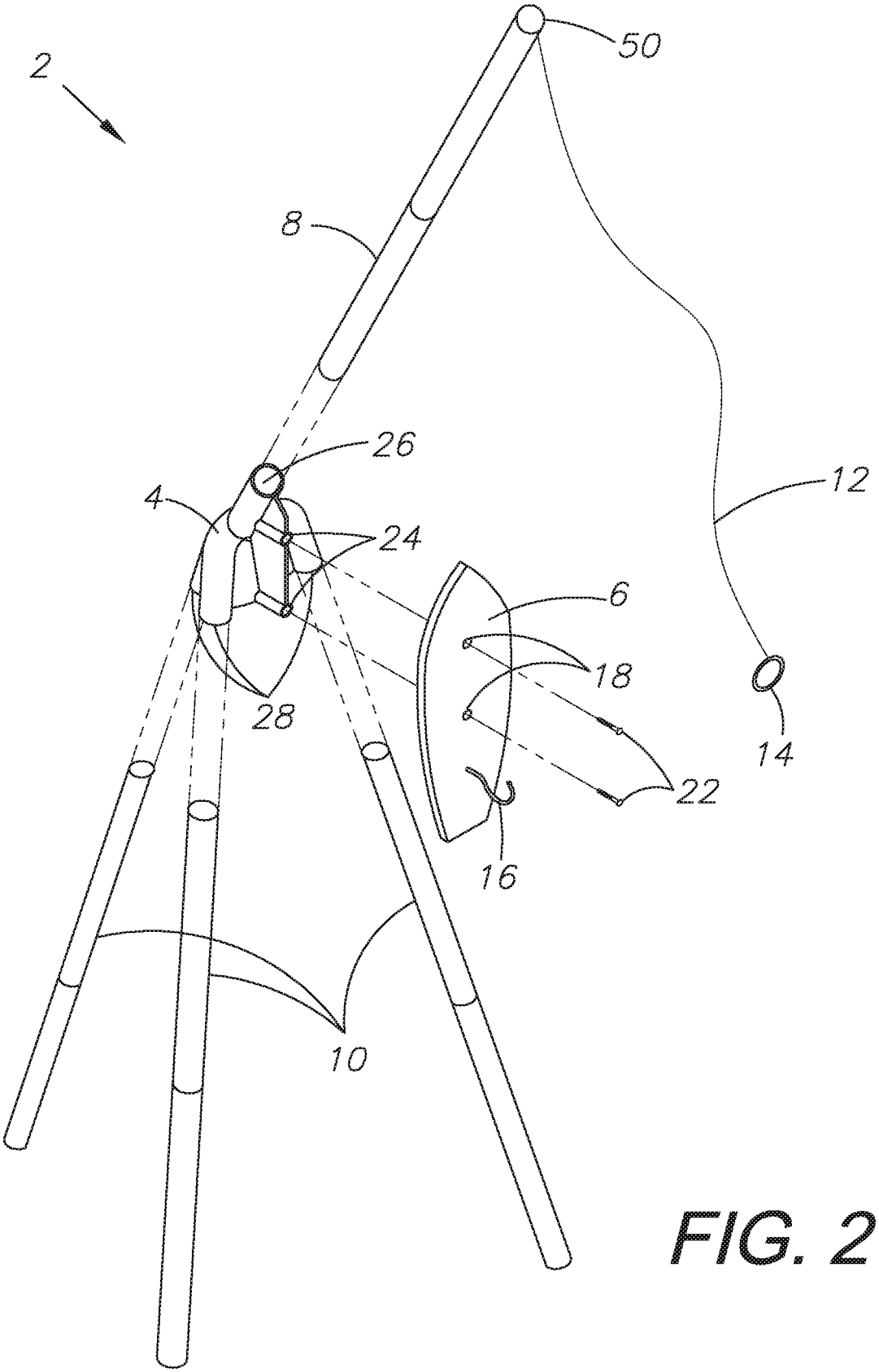
FIG. 2 is an exploded isometric view thereof.
Figure 3:
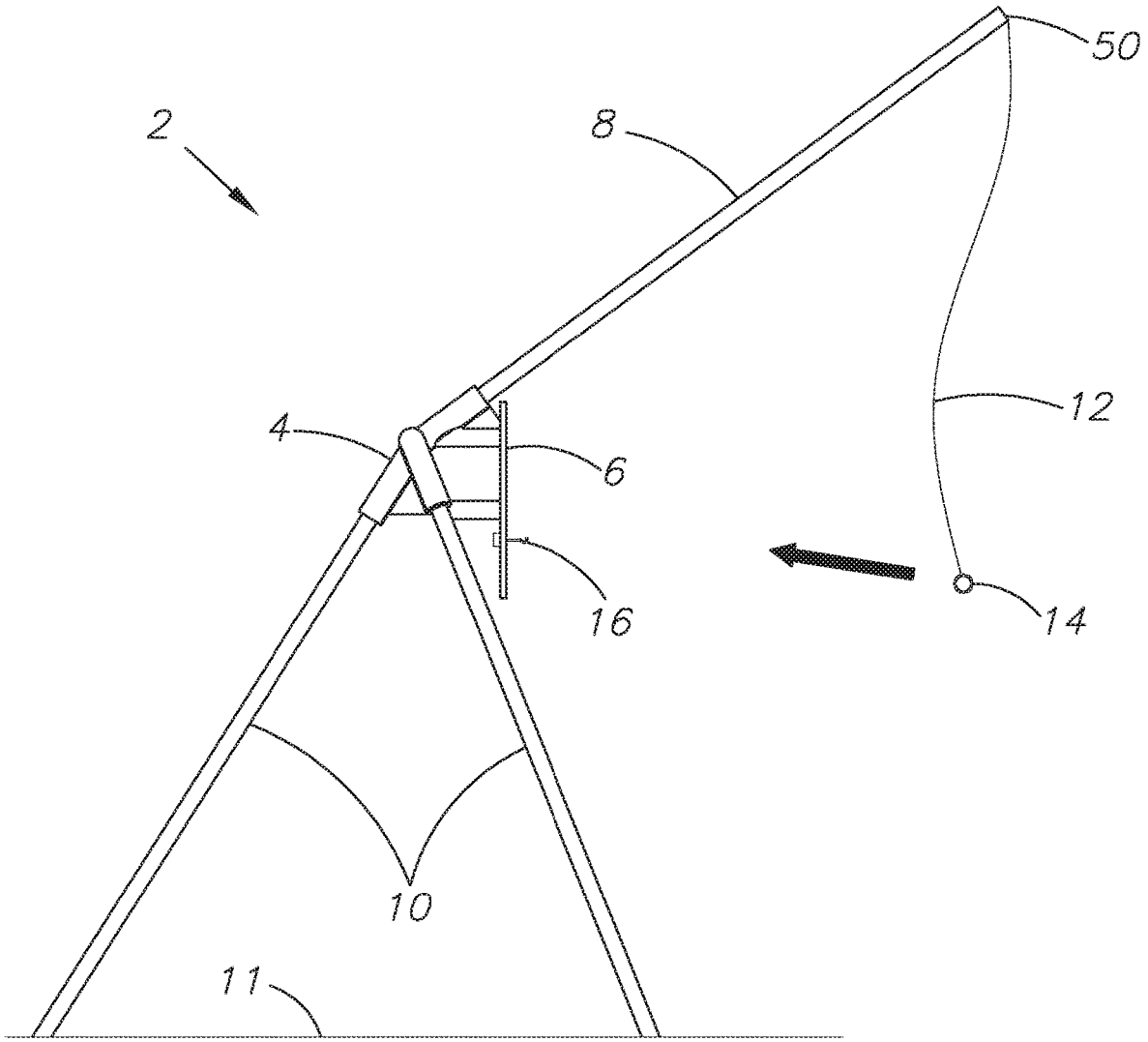
FIG. 3 is a side elevational view thereof.
Figure 4:
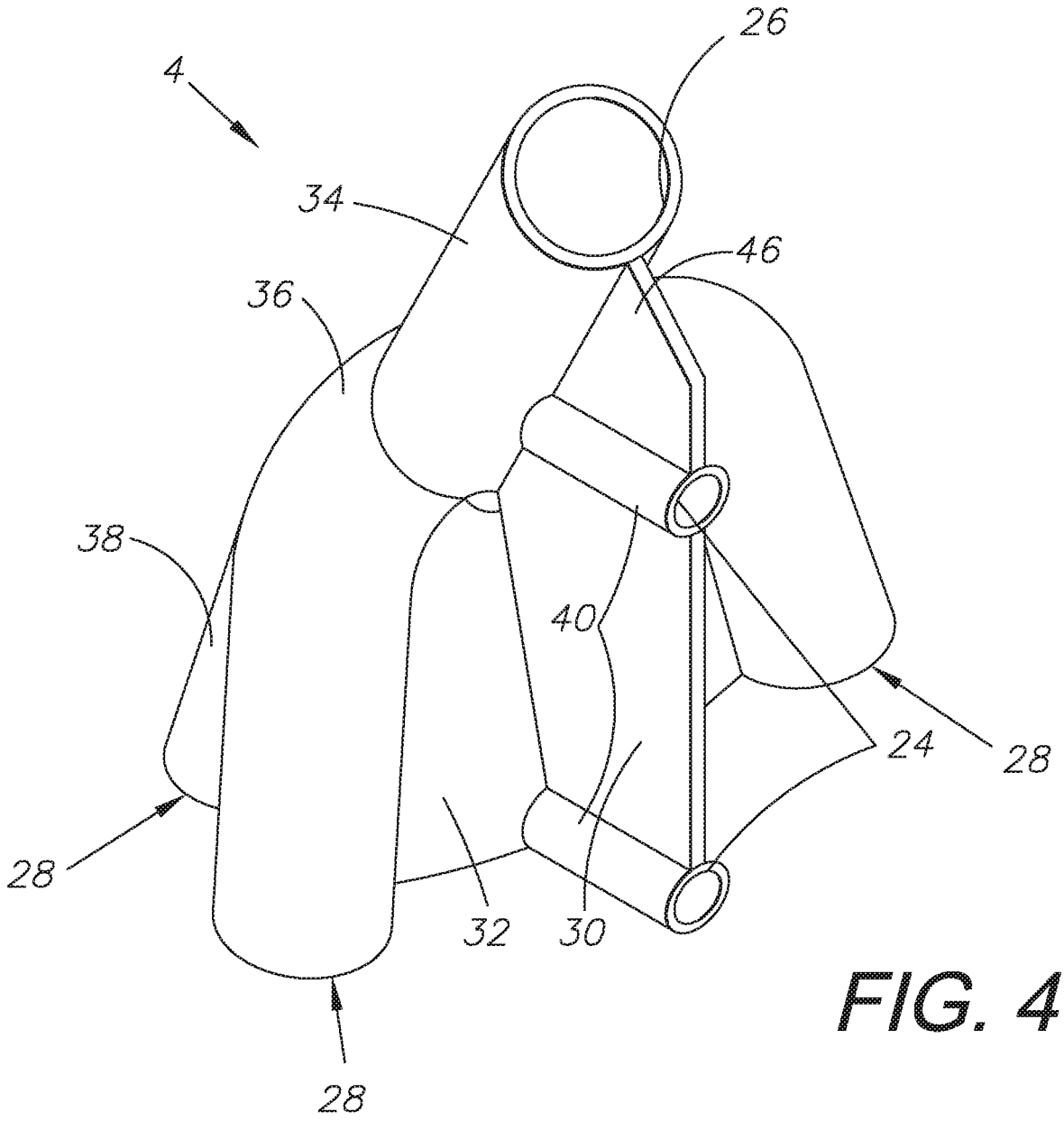
FIG. 4 is a three-dimensional isometric view of a bracket element thereof.
Figure 5:
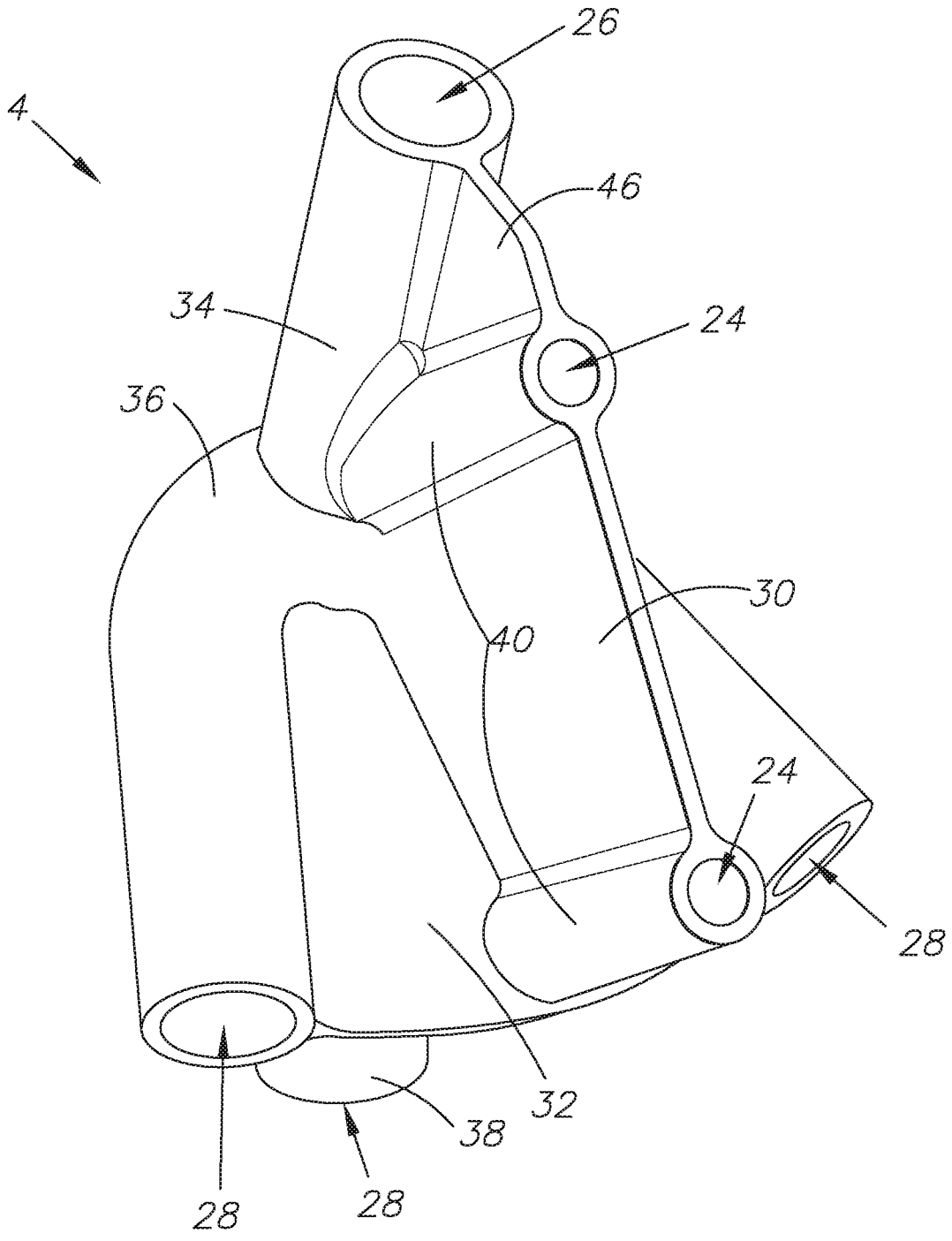
FIG. 5 is a front three-dimensional view thereof.
Figure 6:
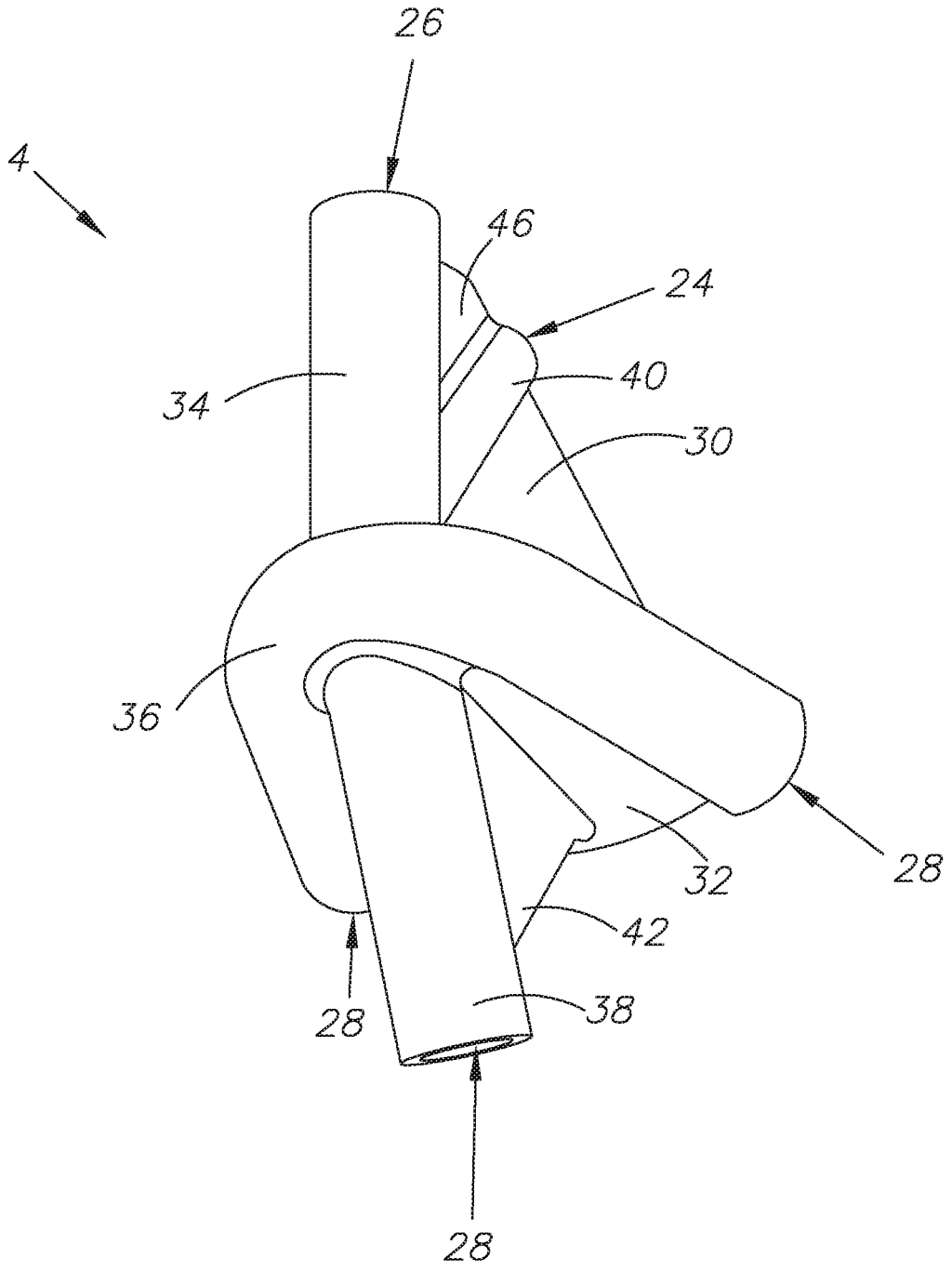
FIG. 6 is a rear top three-dimensional view thereof.
Figure 7:
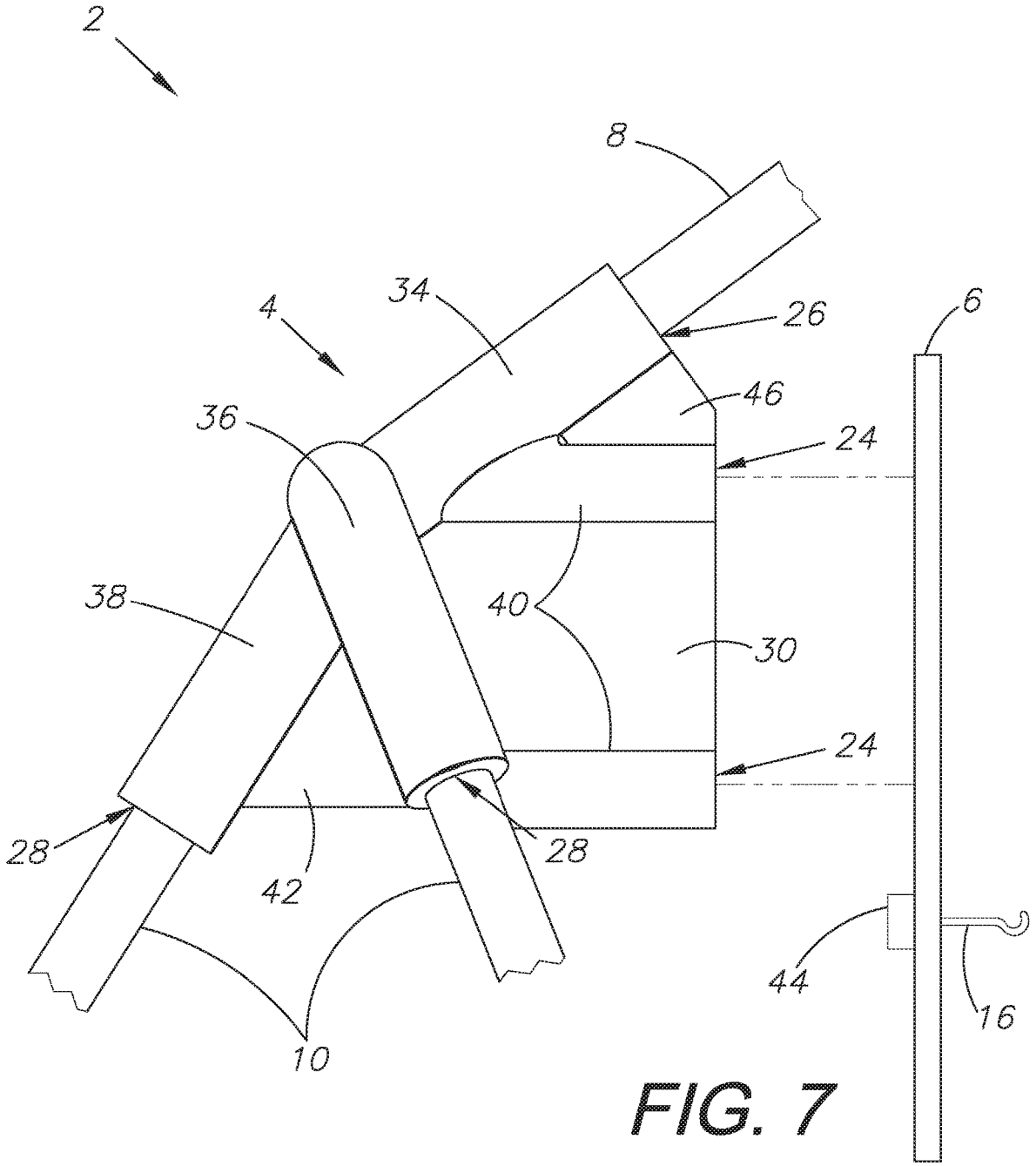
FIG. 7 is a side elevational view thereof.
Figure 8:
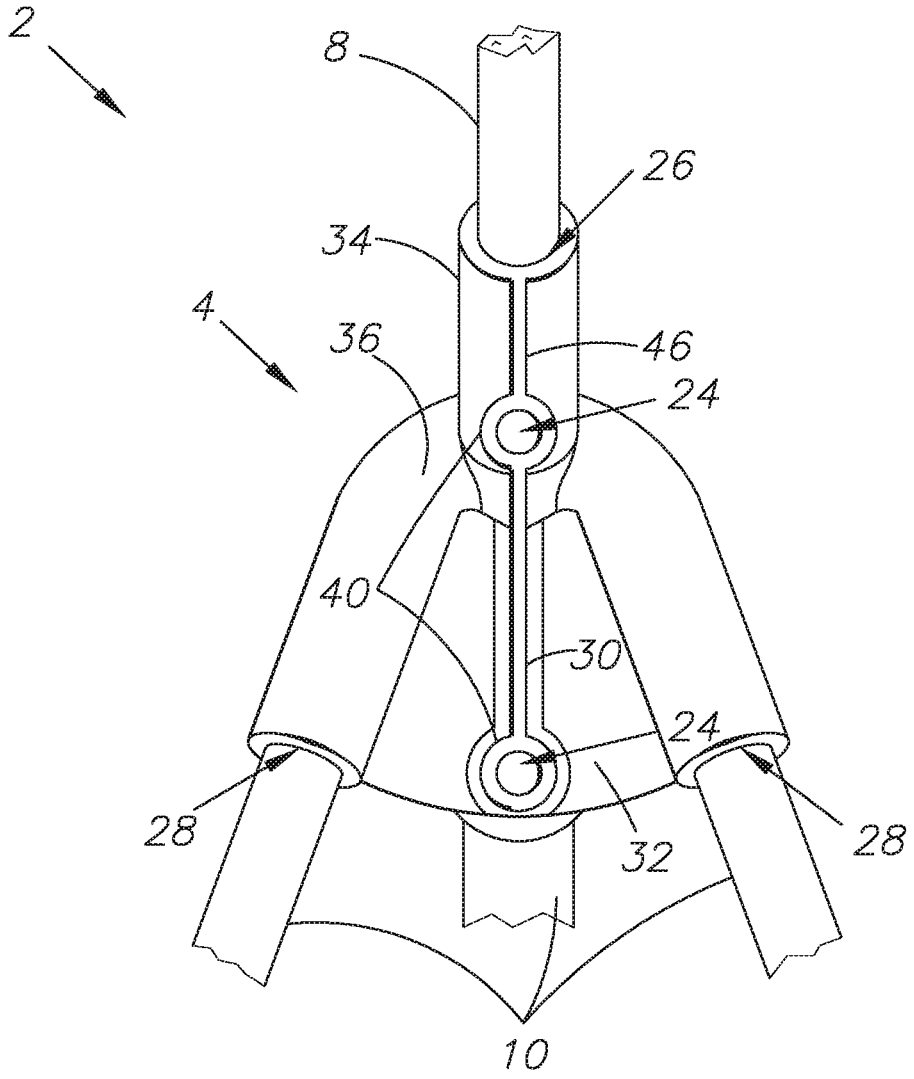
FIG. 8 is a front elevational view thereof.
Figure 9:
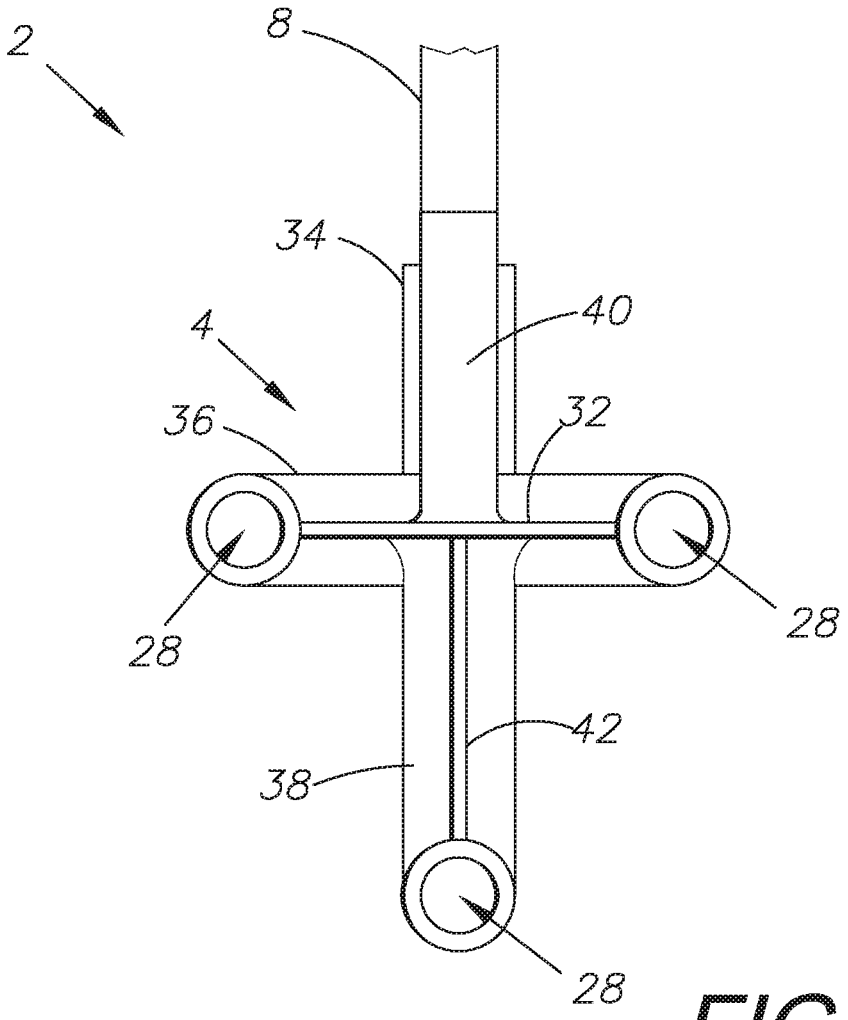
FIG. 9 is a bottom plan view thereof.
Figure 10:
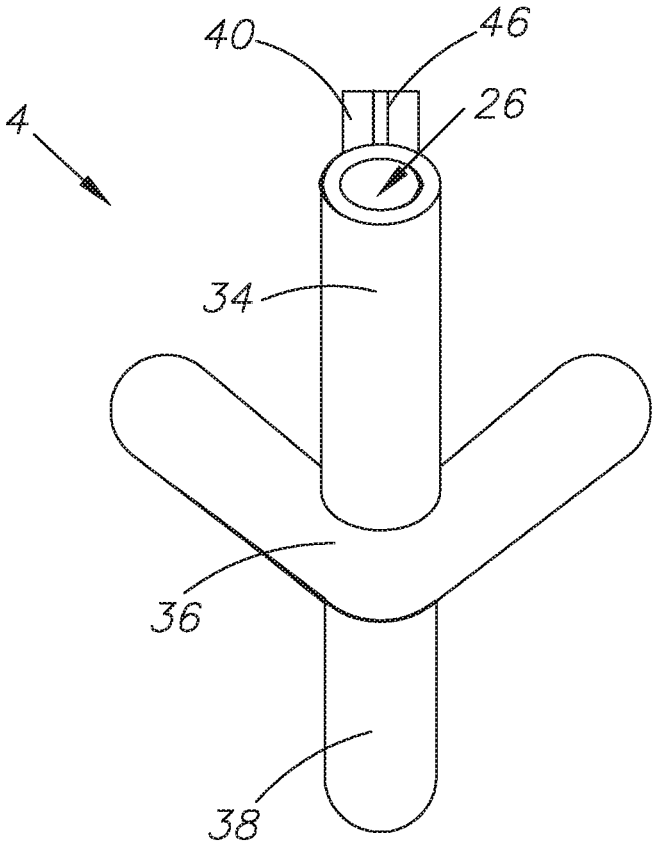
FIG. 10 is a top plan view thereof.
Figure 11:
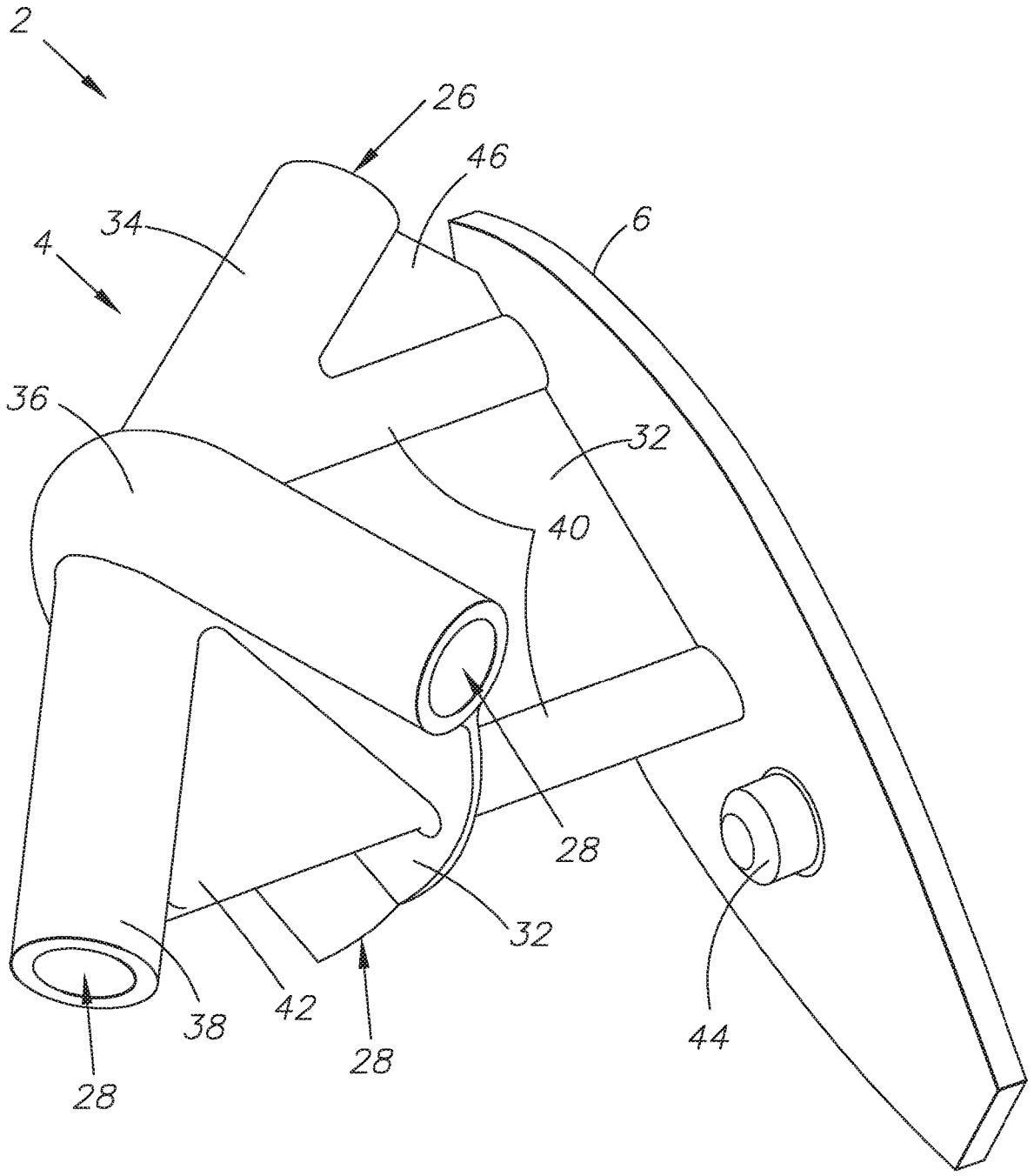
FIG. 11 is a rear bottom three-dimensional view thereof including a backboard element connected thereto.
Figure 12:
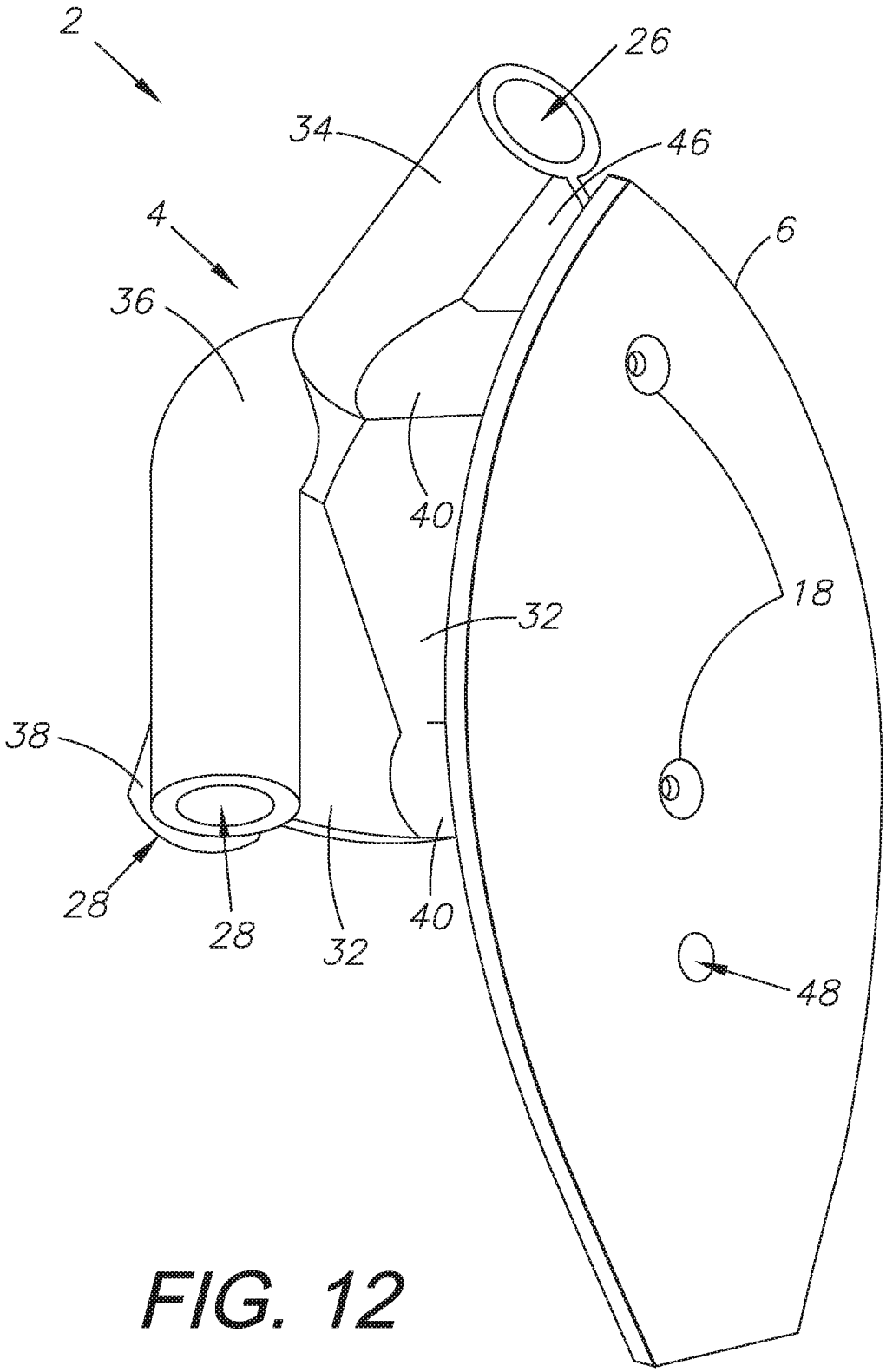
FIG. 12 is a front three-dimensional view thereof.
Figure 13:
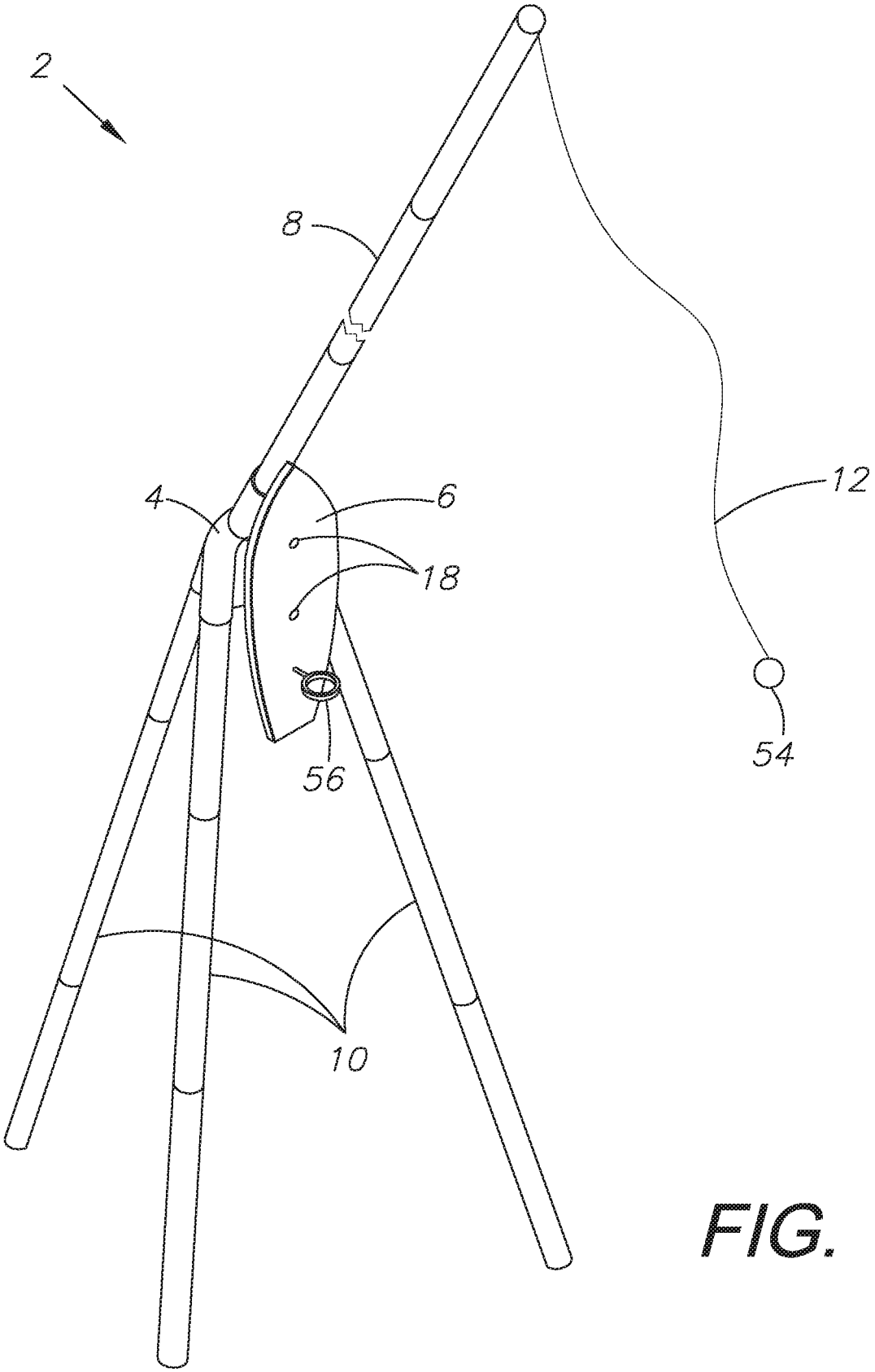
FIG. 13 is a three-dimensional isometric view of a slightly alternative embodiment of the present invention.

A string 12 is anchored to the terminal end point 50 of the telescoping arm 8 as shown in FIGS. 1-3. A tossable object, such as a ring 14 or a ball 54, is suspended from the string. FIGS. 1-3 show a ring, whereas FIG. 13 shows an alternative embodiment with a ball 54. The tossable object would be tossed towards the target board 6 which would include a goal such as a basket 56 for receiving a tossable ball 54 object or a hook 16 for receiving a tossable ring 14 object. The goal of the game system is to toss the object such that it is received by the goal.

The three tripod legs 10 and telescoping arm 8 may all be disconnected from the bracket 4 as desired. Each tripod leg 10 and telescoping arm 8 may be collapsed or separated into portable pieces which can be stored in a travel bag, box, or other carrying receptacle. This allows the game to be easily set up in any location and then broken down and stored when not in use.

The board 6 connects to the bracket 4 as shown in FIG. 2 using screws 22 or other mounting devices inserted through mounting holes 18 in the board into the screw receivers 24 of the bracket. The hook 16 can be removed from the hook receiver hole 44 which leads to a hook receiver 44.

The bracket 4 includes an arm receiver 26 and three leg receivers 28. As shown in FIGS. 4-12 in more detail, the bracket 4 is formed from multiple connecting elements which form the various receivers 24, 26, 28. A U-shaped arch 36 overlaps a lower tube 38 and upper tube 34. The arch 36 houses two of the leg receivers 28, and the lower tube 38 houses the third leg receiver 28. The top tube 34 houses the arm receiver 26. A pair of front tubes 40 house the screw receivers 24. A central wall 32 located underneath of the arch 36 supports the arch. A rear wall 42 connects the lower tube 38 to the central wall 32. A front wall 30 connects the front tubes 40, and an upper front wall 46 supports the upper tube 34.

The basket 54 targets for a tossable ball object could include a golf tee shape or basketball hoop and net shape as shown, or any other desirable basket-type shape.

The target backboard 6 could be made of bamboo or any other suitable material. The bracket or yoke 4 would be of a suitable material to provide weight to the game system 2 to prevent shifting or sliding during play.

The present invention could also operate without a bracket, whereby instead all of the telescoping legs and telescoping arm simply fold up or collapse into a centralized location.

The invention is designed to be freestanding with no requirements for weights, ground anchors, or stakes.

Figure 14:
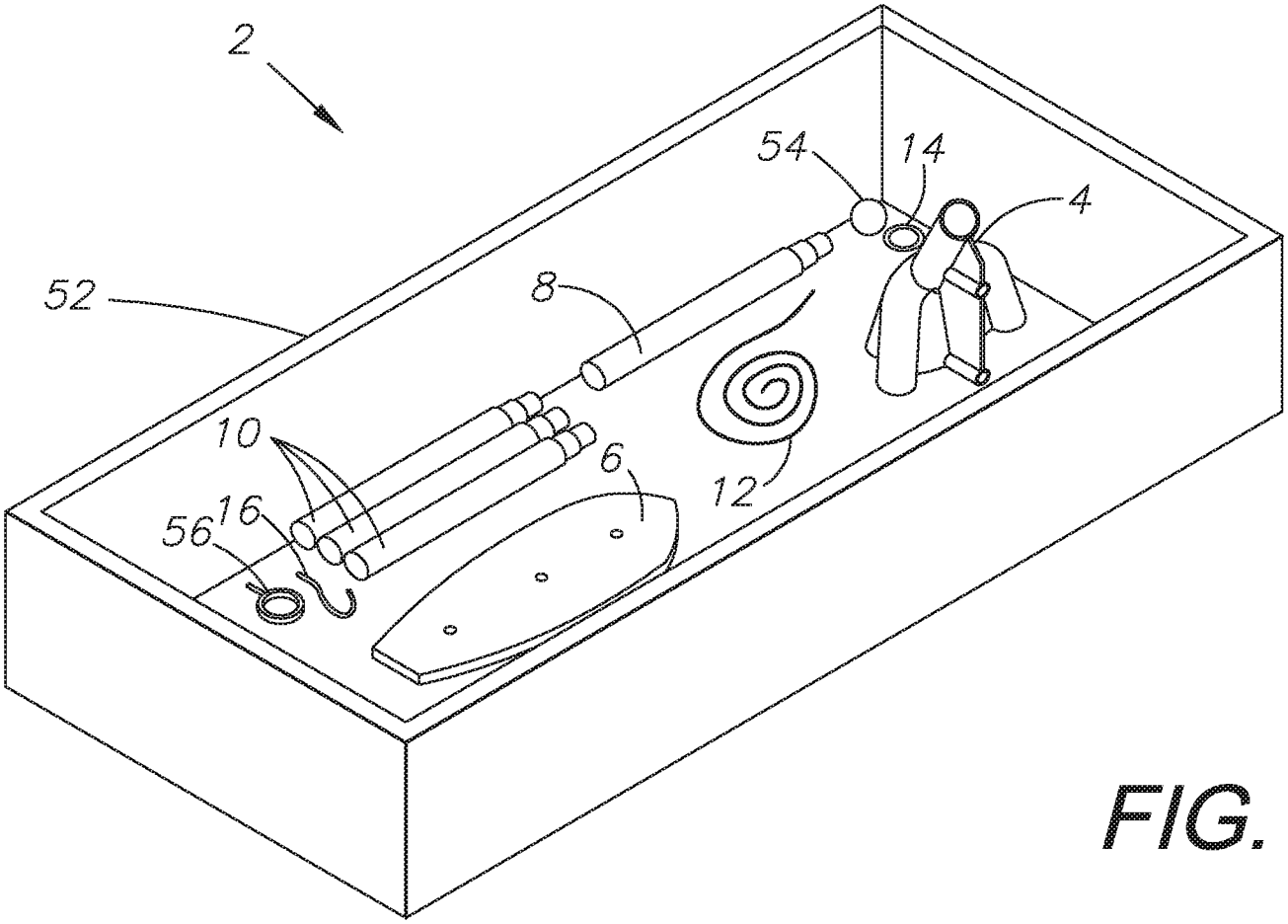
FIG. 14 is a three-dimensional isometric view of a preferred embodiment of the present invention in an unassembled orientation stored in a box.

FIG. 14 shows how the entire game system 2 could be disassembled and stored in a carrying case 52.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A game system comprising:
a backboard with a front face;
three telescoping legs;
a telescoping arm having a distal end;
a tossable object connected to a string affixed to said distal end of said telescoping arm, said distal end of said telescoping arm being located a desired distance above and away from said backboard;
a goal connected to said backboard, said goal configured for receiving said tossable object;
a receiver mounted within said backboard for receiving said goal;
a bracket comprising three leg receivers, an arm receiver, and at least one backboard receiver;
said backboard mounted to said bracket via said backboard receiver;
said telescoping arm removably connected to said arm receiver at a proximal end of said telescoping arm;
each of said telescoping legs removably connected to a respective one of said three leg receivers of said bracket; and
wherein said game system is configured to be transformed from a first, disassembled orientation to a second, assembled orientation.

2. The system of claim 1, further comprising:
said bracket comprising an arched tube comprising two of said three leg receivers;
said bracket comprising a lower tube comprising a third of said three leg receivers;
said bracket comprising an upper tube comprising said arm receiver; and
said bracket comprising at least one front tube comprising said at least one backboard receiver.

3. The system of claim 2, further comprising:
a first structural wall located beneath said arched tube;
a second structural wall connecting said lower tube to said first structural wall;
a third structural wall connecting said at least one front tube to said first structural wall; and
a fourth structural wall connecting said at least one front tube to said upper tube.

4. The system of claim 1, further comprising:
wherein said tossable object comprises a ring; and
wherein said goal comprises a hook.

5. The system of claim 1, further comprising:
wherein said tossable object comprises a ball; and
wherein said goal comprises a basket.

6. A method of assembling and using a game system, the method comprising the steps:
extending three telescoping legs and inserting a first end of each one of said three telescoping legs into a respective one of three leg receivers of a bracket;
extending a telescoping arm and inserting a first end of said arm into an arm receiver of said bracket;
affixing a backboard to a backboard receiver of said bracket;
connecting a goal into said backboard;
connecting a first end of a string to a second end of said telescoping arm, whereby said string is extended out and away from said backboard;
connecting a tossable object to a second end of said string; and
tossing said tossable object toward said goal.

7. The method of claim 6, wherein:
said bracket comprising an arched tube comprising two of said three leg receivers;
said bracket comprising a lower tube comprising a third of said three leg receivers;
said bracket comprising an upper tube comprising said arm receiver; and
said bracket comprising at least one front tube comprising said at least one backboard receiver.

8. The method of claim 7, wherein:

said bracket comprising a first structural wall located beneath said arched tube;

said bracket comprising a second structural wall connecting said lower tube to said first structural wall;

said bracket comprising a third structural wall connecting said at least one front tube to said first structural wall; and said bracket comprising a fourth structural wall connecting said at least one front tube to said upper tube.

9. The method of claim 6, wherein:

said tossable object comprises a ring; and said goal comprises a hook.

10. The method of claim 6, wherein:

said tossable object comprises a ball; and said goal comprises a basket.

11. A game system comprising:

a backboard with a front face;

a plurality of telescoping legs;

a telescoping arm having a distal end;

a tossable object connected to a string affixed to said distal end of said telescoping arm, said distal end of said telescoping arm being located a desired distance above and away from said backboard;

a goal connected to said backboard, said goal configured for receiving said tossable object;

a receiver mounted within said backboard for receiving said goal;

a bracket comprising a plurality of leg receivers, an arm receiver, and at least one backboard receiver;

said backboard mounted to said bracket via said backboard receiver;

said telescoping arm removably connected to said arm receiver at a proximal end of said telescoping arm;

each of said telescoping legs removably connected to a respective one of said plurality of leg receivers of said bracket; and wherein said game system is configured to be transformed from a first, disassembled orientation to a second, assembled orientation.

12. The system of claim 11, further comprising:

said bracket comprising an arched tube comprising two of said three leg receivers;

said bracket comprising a lower tube comprising a third of said three leg receivers;

said bracket comprising an upper tube comprising said arm receiver; and said bracket comprising at least one front tube comprising said at least one backboard receiver.

* * * * *